US007901250B2

(12) United States Patent
Lam et al.

(10) Patent No.: US 7,901,250 B2
(45) Date of Patent: Mar. 8, 2011

(54) ELECTRICAL ADAPTER FOR A CONNECTOR HAVING A RETENTION LATCH

(75) Inventors: Bill Lam, Taipei (TW); Ian Lin, Taipei (TW); Mark Wiltse, Taipei (TW)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/581,437

(22) Filed: Oct. 19, 2009

(65) Prior Publication Data

US 2010/0112845 A1 May 6, 2010

(30) Foreign Application Priority Data

Oct. 31, 2008 (TW) ..... 97142431 A

(51) Int. Cl.
*H01R 33/94* (2006.01)

(52) U.S. Cl. ..... 439/638; 439/352; 439/676

(58) Field of Classification Search ..... 439/344, 439/352–354, 638, 676
See application file for complete search history.

(56) References Cited

U.S. PATENT DOCUMENTS

| | | | | |
|---|---|---|---|---|
| 5,222,897 | A * | 6/1993 | Collins et al. | 439/157 |
| 7,223,109 | B1 | 5/2007 | Cors | |
| 7,335,066 | B2 | 2/2008 | Carroll et al. | |
| 2005/0014412 | A1 | 1/2005 | Wharton | |
| 2006/0046575 | A1 | 3/2006 | Allen | |

* cited by examiner

*Primary Examiner* — Khiem Nguyen
(74) *Attorney, Agent, or Firm* — Adam M. Steadman; Cynthia G. Seal

(57) ABSTRACT

An electrical adapter is provided for engaging a connector plug. The adapter comprises a male end, a female end, and a retention member. The male end is disposed at one end of the adapter for connecting the adapter to a female receptacle corresponding to the connector plug. The female end is disposed at another end of the adapter for engaging the connector plug. The female end comprises a top cap having a button disposed thereon. The retention member comprises a holder section, an energy storage section, and an energy release section. The holder section holds the connector plug. The energy storage section stores energy resulting from when the connector plug engages the retention member. When engaged by the button, the energy release section releases the energy stored in the energy storage section such that the connector plug automatically ejects from the adapter.

19 Claims, 8 Drawing Sheets

ELECTRICAL ADAPTER FOR A CONNECTOR HAVING A RETENTION LATCH

RELATED APPLICATION

This application claims priority under 35 U.S.C. §119 to Taiwanese Patent Application No. 97142431 filed Oct. 31, 2008, the entire text of which is specifically incorporated by reference herein.

FIELD OF THE INVENTION

The various embodiments described herein relate to an apparatus for a connector having a retention latch, including a connector attached to the end of a cord carrying electrical or optical signals, and more particularly to an electrical adaptor for a connector having a damaged retention latch.

BACKGROUND OF THE INVENTION

Signal transmission lines, such as telephone lines, fiber optic lines, Ethernet lines, and the like are often connected to receiving units (e.g., wall outlets or female receptacles on other devices) via flexible conductors or lines having plug-in type connectors on their ends. RJ11, 8P8C, MT-RJ, and LC fiber-optic connectors are examples of plug-in connectors having retention latches.

Modern computers usually are connected to some type of network in order to share resources. Examples of such networks include the Internet, Wide Area Networks (WANs), and Local Area Networks (LANs). In order to access a network such as a LAN, a client computer must be coupled to the LAN either wirelessly or via hard wiring. A popular hard wiring system utilizes connectors known as 8P8C connectors (sometimes referred to as RJ45 connectors).

FIG. 1 is a cross-sectional side view of an 8P8C plug of a conventional 8P8C connector. The 8P8C plug is sometimes referred to as a RJ45 plug. The 8P8C plug 100 typically is formed of plastic and comprises a latch base 120 and a flexible retention latch 130. The retention latch 130 is sometimes referred to as a connector tab or a latching tab and is integrally molded as part of the plastic 8P8C plug 100. RJ11, MT-RJ, and LC fiber-optic connectors also have flexible retention latches. The retention latch 130 comprises a stem 134 and a finer flexible section 132 coupled to the latch base 120. A pair of shoulders 136 is disposed on the connection between the stem 134 and the flexible section 132 as lock points. A vacant space 138 exists between the retention latch 130 and the 8P8C plug 100, and thus the retention latch 130 can be flexed. In addition, the back end of the 8P8C plug 100 is attached to a cable 110.

When the 8P8C plug 100 is inserted into a network port in a machine or a wall outlet, the retention latch 130 of the 8P8C plug 100 flexes as it rides over a pair of spaced apart retention lips 139 inside a female 8P8C receptacle 200 (see FIG. 2) and snaps into a locked attachment with the 8P8C female receptacle 200. The pair of shoulders 136 of the retention latch 130 engages the pair of retention lips 139. When a user desires to disconnect the 8P8C plug 100, the stem 134 of the retention latch 130, which extends outside of the female 8P8C receptacle 200, is pressed down to disengage the pair of shoulders 136 from the pair of retention lips 139 so that the 8P8C plug 100 can be removed.

The flexible retention latch 130 of the 8P8C plug 100 is usually fragile. If the retention latch 130 is damaged (i.e., broken) within the flexible section 132, the 8P8C plug 100 cannot be retained in the female 8P8C receptacle 200. If the retention latch 130 is damaged within the stem 134 (e.g., the stem 134 has broken off), the 8P8C plug 100 can be retained in the female 8P8C receptacle 200, but the 8P8C plug 100 can be difficult to remove. FIG. 2 shows a cross-sectional side view of the 8P8C plug 100 with a retention latch 130, of which the stem 134 is damaged, wherein the 8P8C plug 100 engages the female 8P8C receptacle 200. As illustrated, the pair of shoulders 136 of the retention latch 130 whose stem 134 is broken off engages the pair of retention lips 139 inside the female 8P8C receptacle 200. However, to remove the 8P8C plug 100, it is difficult to disengage the pair of shoulders 136 from the pair of retention lips 139 due to the damaged stem 134. In such case, an external object such as a thin sticker is often needed to press down the retention latch 130 so that the 8P8C plug 100 can be removed. Often, when the retention latch 130 is damaged or becomes detached from the 8P8C plug 100, it is necessary to either replace the entire cable with plug combination or replace the damaged plug itself. Replacing the damaged plug is difficult and impractical because it requires tools and skills to process the very fine wire gauge. Thus, the entire cable with plug combination is usually discarded and replaced, but such replacement is not cost effective.

A solution is provided in U.S. Patent Publication No. 2006/0046575A1, which discloses an electrical adapter comprising a female end and a male end. The female end of the electrical adapter is provided for electrically receiving a male RJ11 plug with broken latching tab removed, while the male end comprises an unbroken latching tab and is substantially similar in shape to the male plug. The female end comprises a retaining tab for holding the male plug securely in place. However, if a user desires to remove the male plug with broken latching tab from the female end, a releasing device must be manually inserted into the female end of the adapter to release the male plug. In addition, if the broken latching tab is not damaged at the position of the latch base 120 as illustrated in FIG. 1, the female end of the adapter will not be able to receive the male RJ11 plug.

Another solution is provided by U.S. Pat. No. 7,223,109, which discloses a replacement latch to be added for retention of a damaged male 8P8C plug whose molded flexible latch has been broken off. However, the replacement latch includes multiple parts (at least three) mounted within a tiny space inside the male 8P8C plug, and thus it is difficult to manufacture/assemble the replacement latch. Moreover, if the flexible latch is not damaged at the position of the latch base 120 as illustrated in FIG. 1, the replacement latch will not be compatible with a male 8P8C plug due to a lack of free space for inserting any additional parts inside a female 8P8C receptacle.

Accordingly, a practical and reliable solution is required for accommodating a plug with any type of damaged retention latch without requiring replacement of the plug itself or an entire cable with plug connected thereto.

SUMMARY OF THE INVENTION

The various embodiments described herein provide a novel electrical adapter that can accommodate a connector plug having any type of damaged flexible retention latch. In addition, the novel electrical adapter can accommodate a connector plug having an undamaged flexible retention latch. In accordance with an exemplary embodiment, the novel electrical adapter has a male end similar in shape to the conventional 8P8C plug and a female end. A retention member mounted inside of the female end is provided for holding the connector plug. The retention member comprises an energy storage section provided for storing energy resulting from when the connector plug engages the retention member. When the energy storage section releases the energy stored therein, the connector plug is automatically ejected from the adapter.

According to one aspect of the various embodiments described herein, an electrical adapter is provided for engaging a connector plug. The connector plug may be an 8P8C plug, a RJ11 plug, a MT-RJ plug, or a LC plug. The adapter comprises a male end, a female end, and a retention member. The male end is disposed at one end of the adapter for connecting the adapter to a female receptacle corresponding to the connector plug. The female receptacle may be a wall outlet or a receptacle on another device. The male end is substantially similar in shape to the connector plug. The female end is disposed at another end of the adapter for engaging the connector plug. The female end comprises a top cap having a push button disposed thereon. The retention member is formed of stainless steel plate and comprises a holder section, an energy storage section, and an energy release section. The holder section is provided for holding the connector plug. The energy storage section is provided for storing energy resulting from when the connector plug engages the retention member. The energy release section is provided for releasing the energy stored in the energy storage section when engaged by the button such that the connector plug automatically ejects from the adapter.

The holder section of the retention member comprises a pair of V-shape arms, and each of the pair of V-shape arms comprises a holder. The energy storage section comprises a pair of V-shape springs. The energy release section comprises a spring latch having a latch hole for engagement with a protrusion point on the female end. The latch hole engages the protrusion point when the connector plug engages the retention member. In addition, the retention member comprises a push tab via which the retention member is driven when the connector plug is inserted into the female end.

Furthermore, the female end of the adapter comprises a body comprising a first compartment for receiving the connector plug and a second compartment for receiving the energy storage section and the energy release section.

According to another aspect of the various embodiments described herein, a female receptacle is provided for engaging a connector plug. The female receptacle comprises a body, a top cap, and a retention member. The body is provided for receiving the connector plug. The top cap is mounted on the body and has a push button disposed thereon. The retention member comprises a holder section, an energy storage section, and an energy release section. The holder section is provided for holding the connector plug. The energy storage section is provided for storing energy resulting from when the connector plug engages the retention member. The energy release section is provided for releasing the energy stored in the energy storage section when engaged by the button such that the connector plug automatically ejects from the adapter.

BRIEF DESCRIPTION OF THE DRAWINGS

The various embodiments will be described in detail with reference to the following figures, wherein.

DETAILED DESCRIPTION

Figure 1:
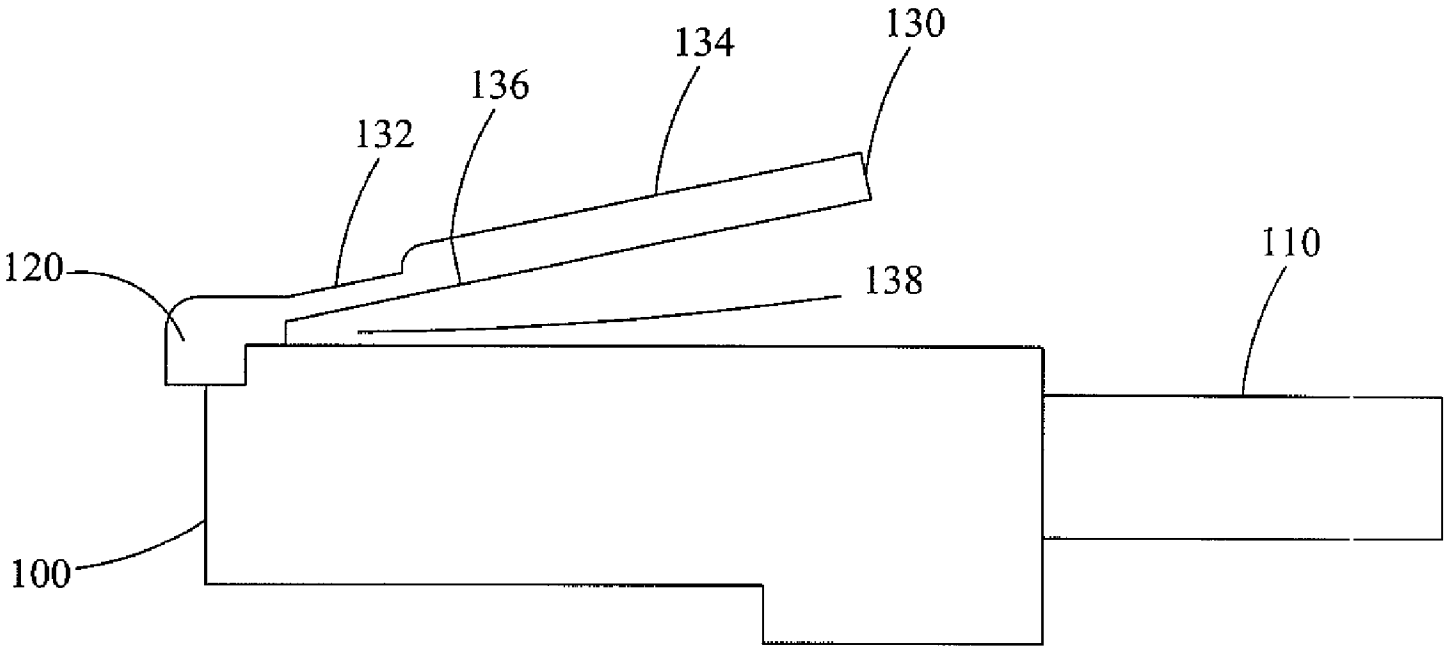
FIG.1 PRIOR ART
FIG. 1 shows a cross-sectional side view of an 8P8C plug of a conventional 8P8C connector.
Figure 2:
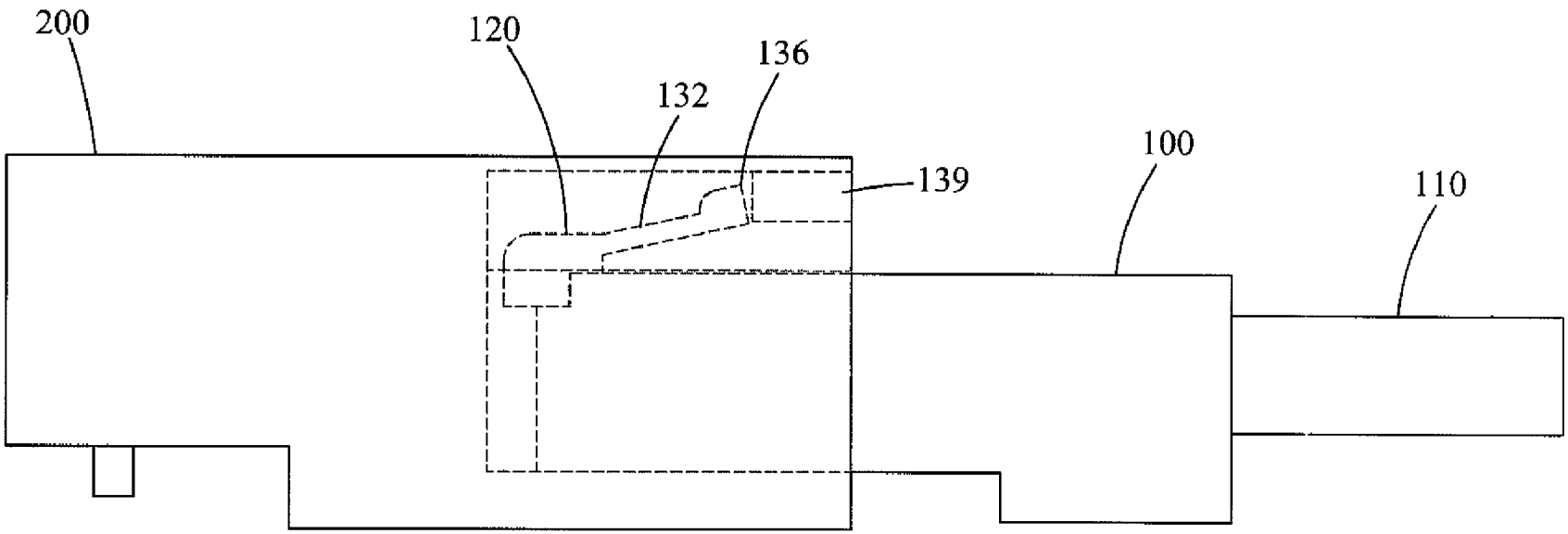
FIG. 2 shows a cross-sectional side view of an 8P8C plug having a damaged retention latch engaging a female 8P8C receptacle.

The following describes various exemplary embodiments. The exemplary embodiments are for illustrative purposes only. Thus, it will be understood by those skilled in the art that modifications may be made to the various embodiments described herein without departing from the spirit and scope of the disclosure. Throughout the drawings, similar features are identified by similar reference numerals.

The various embodiments described herein are designed to make serviceable a plug having a damaged (i.e., broken) retention latch attached to the end of a cable carrying electrical or optical signals. For purposes of simplicity, the various embodiments will be described by using the 8P8C connector as an example. Those skilled in the art will readily realize that the material disclosed in the specification can be applied other connectors, including RJ11, MT-RJ, and LC fiber-optic connectors.

Figure 3A:
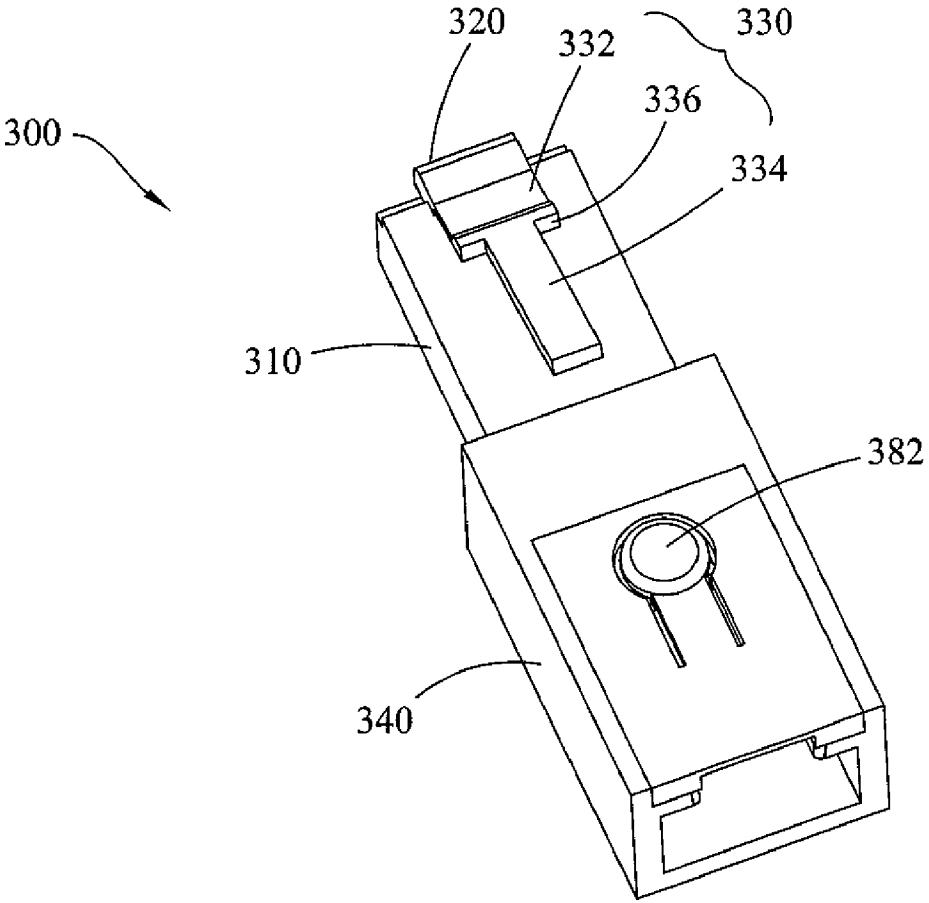
FIG. 3A and FIG. 3B are respectively an assembled perspective view and an exploded perspective view that show an adapter in accordance with an exemplary embodiment.
Figure 3B:
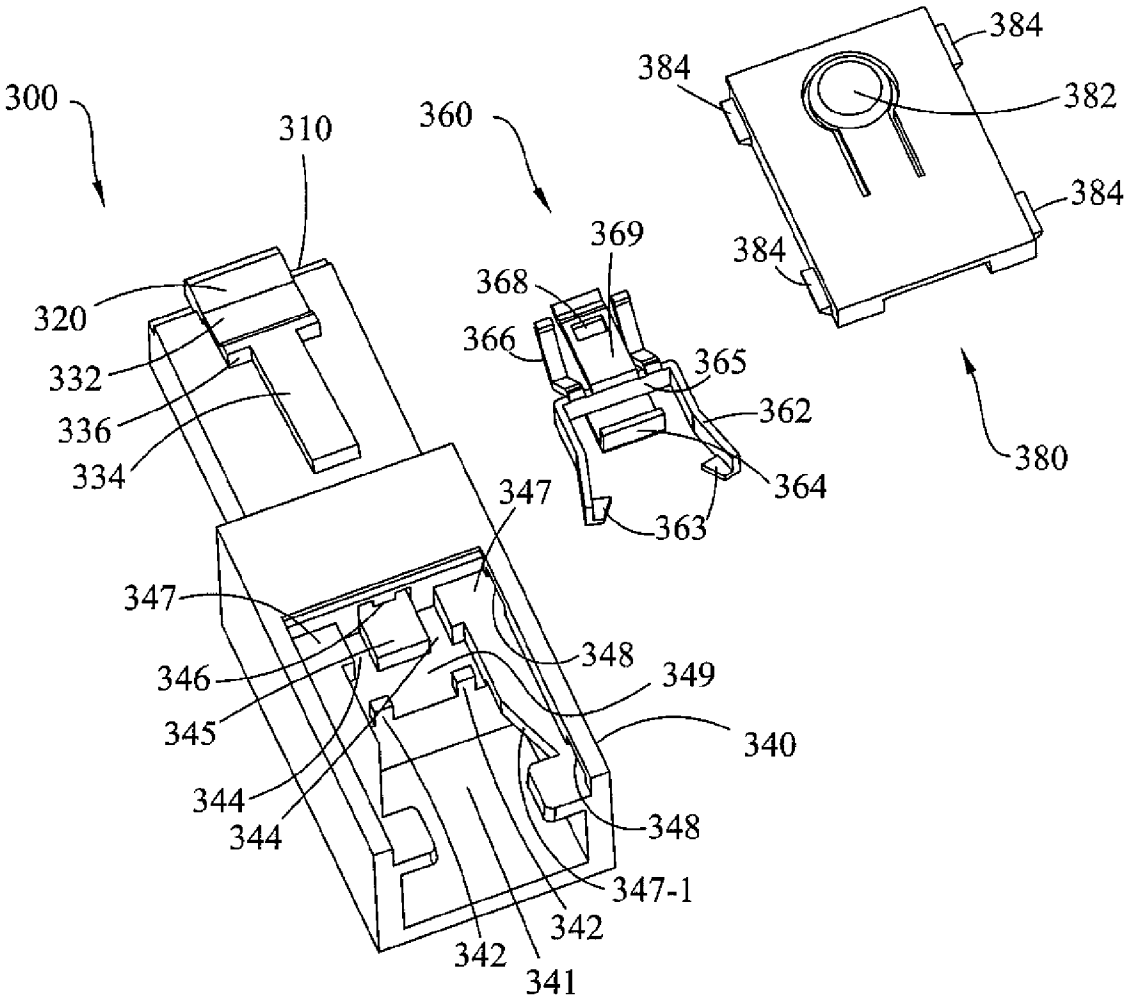

FIG. 3A and FIG. 3B are respectively an assembled perspective view and an exploded perspective view that show an adapter 300 in accordance with an exemplary embodiment. As shown in FIG. 3A, the body of the adapter 300 is typically formed of plastic and comprises a male end 310 similar to the 8P8C plug 100 and a female end 340. A top cap 380 is mounted on the female end 340, and a button 382 is disposed on the top cap 380. Engaging members 384 are respectively disposed on two sides of the top cap 380 for engaging corresponding mated holes 348 inside the female end 340. Moreover, the female end 340 comprises female end electrical contacts (not shown) for electrical connection with electrical contacts of an inserted 8P8C plug (not shown). The male end 310 is substantially similar in shape to the 8P8C plug 100 and typically comprises an undamaged retention latch 330 and a latch base 320. The retention latch 330 comprises a stem 334 and a finer flexible section 332 coupled to the latch base 320. A pair of shoulders 336 is disposed on the connection between the stem 334 and the flexible section 332 as lock points. The pair of shoulders 336 is provided for engaging a pair of spaced apart retention lips (not shown) inside a receiving unit (e.g., female receptacle). The retention latch 330 is thus snapped into a locked attachment when the male end 310 of the adapter 300 is inserted into a wall outlet or the female receptacle on another device (e.g. a computer system, a DSL Modem, etc.). The male end 310 further comprises male end electrical contacts (not shown) for electrically connecting the adapter 300 to a wall outlet or a female receptacle on another device.

FIG. 3B illustrates an exploded perspective view of the female end 340 of the adapter 300 in accordance with an exemplary embodiment. A retention member 360 is mounted inside the female end 340. The retention member 360 is formed of flexible stainless steel plate and typically comprises a beam 365, a pair of V-shape arms 362 with holders 363 respectively extending forward from the two ends of the beam 365, a pair of V-shape springs 366 disposed on the side of the beam 365 opposite to the pair of V-shape arms 362, a push tab 364 disposed at the middle of the beam 365 and on the same side as the pair of V-shape arms 362, and a spring latch 369 disposed at the middle of the beam 365 and on the side opposite to the push tab 364. The spring latch 369 comprises a latch hole 368 formed thereon.

Within the body of the female end 340, a deeper first compartment 341 is located at the entry end for receiving the body of an 8P8C plug (not shown). Moreover, the female end 340 comprises a shallower second compartment 349 for receiving the beam 365, the spring latch 369, and the pair of V-shape springs 366 of the retention member 360. The second compartment 349 comprises a pair of first ledges 347 respectively disposed on the two sides of the body of the female end 340 and extended to the first compartment 341, a second ledge 345 disposed on the side opposite to the entry end of the female end 340 (i.e., disposed on the side of the female end 340 adjacent to the male end 310), and a pair of spaced apart bosses 342 disposed at the two sides of the boundary between the first compartment 341 and the second compartment 349. A pair of longitudinal recess areas 344 is respectively located at the two sides of the second ledge 345 for receiving the pair of V-shape springs 366 of the retention member 360.

A protrusion point 346 extending downward from the female end 340 is disposed on the upper side of the second ledge 345 of the female end 340 for engaging the latch hole 368 formed on the spring latch 369 of the retention member 360. A pair of V-shape indents 347-1 is formed along the sides of the pair of first ledges 347 to accommodate the pair of V-shape arms 362 of the retention member 360.

Figure 4A:
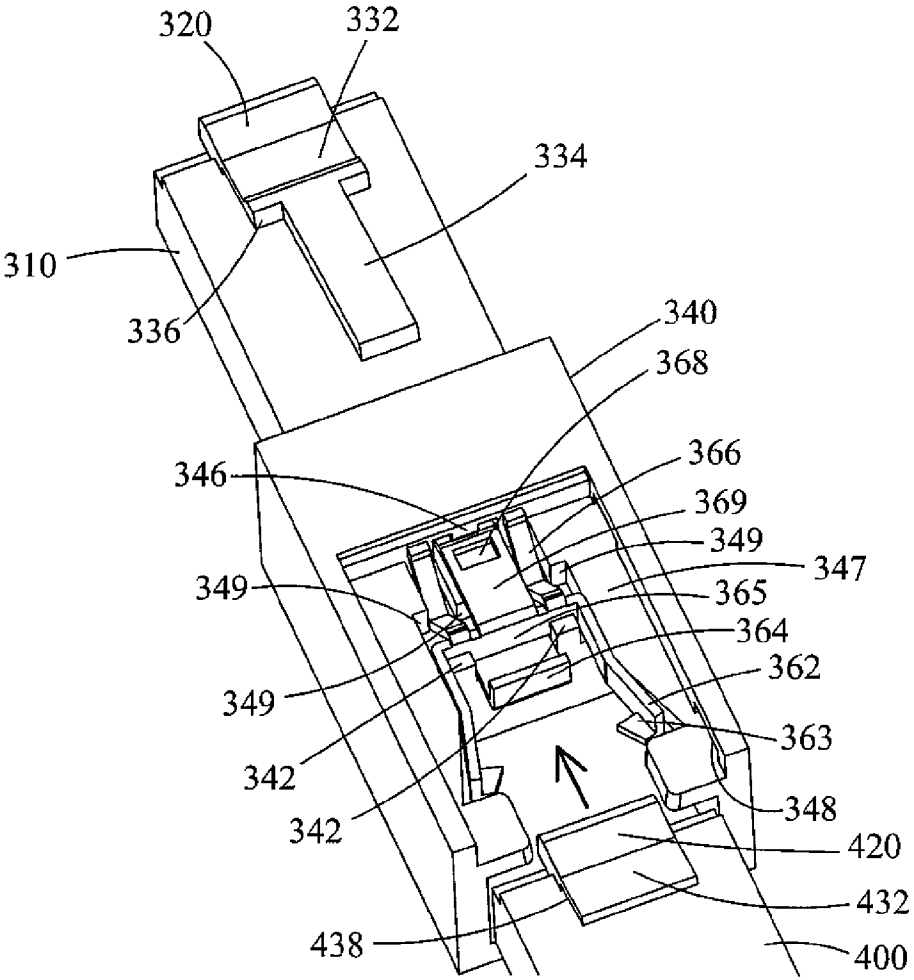
FIGS. 4A-4C are exploded perspective views that show insertion of an 8P8C plug having a damaged retention latch into the female end of the adapter in accordance with an exemplary embodiment.
Figure 4B:
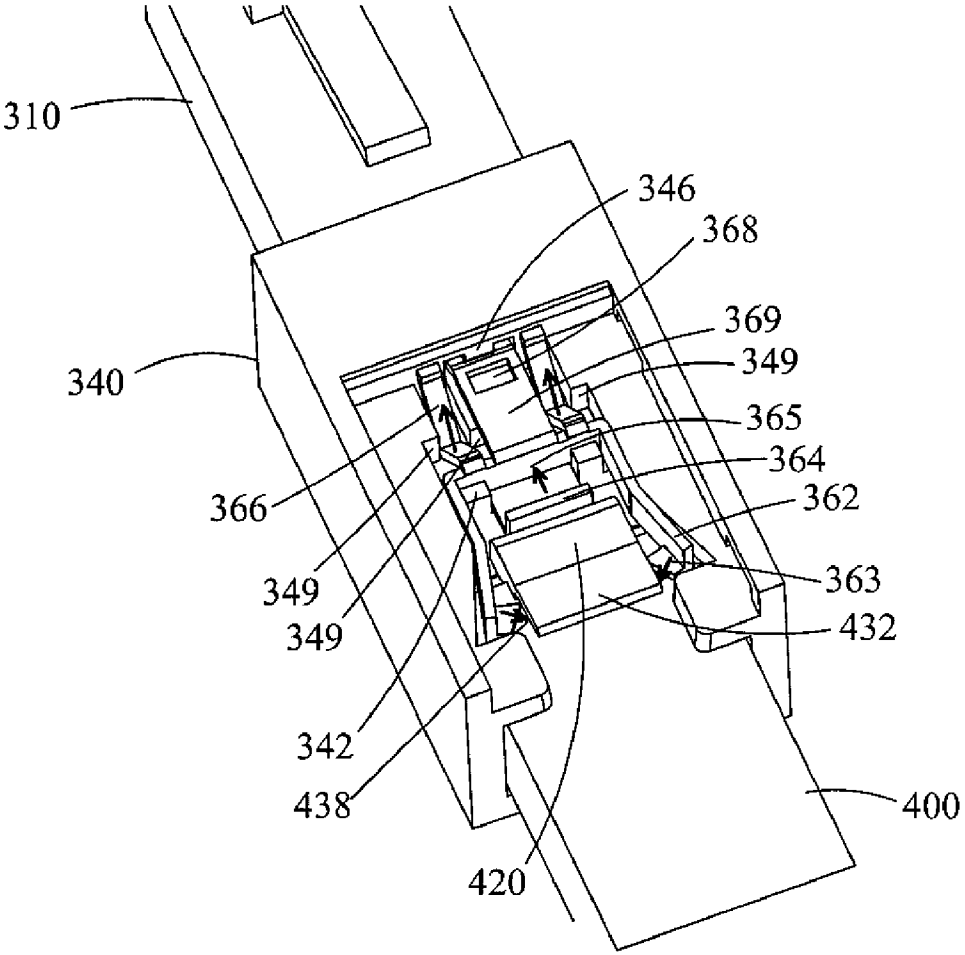
Figure 4C:
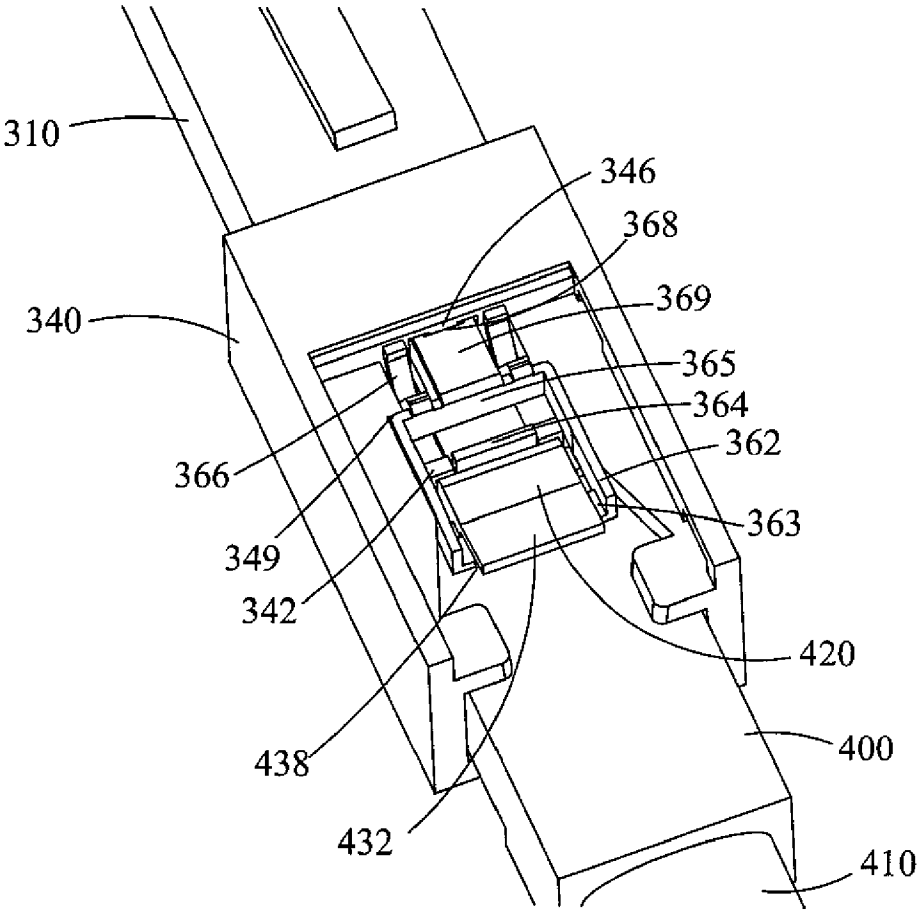

FIGS. 4A-4C are exploded perspective views that show insertion of an 8P8C plug 400 having a damaged retention latch 432 into the female end of the adapter 300 in accordance with an exemplary embodiment. For purposes of clarity, the top cap 380 is not depicted in FIGS. 4A-4C.

As illustrated in FIG. 4A, the retention member 360 is mounted within the female end 340. Specifically, the beam 365 of the retention member 360 is mounted against the pair of spaced apart bosses 342, while the spring latch 369 is mounted on the second ledge 345. The pair of V-shape springs 366 of the retention member 360 is respectively mounted inside of the pair of longitudinal recess areas 344 located at the two sides of the second ledge 345. The pair of V-shape arms 362 rides over the two sides of the pair of spaced apart bosses 342 and is respectively accommodated inside the pair of V-shape indents 347-1 formed along the sides of the pair of first ledges 347. The push tab 364 of the retention member 360 is mounted between the pair of bosses 342 and extends to the first compartment 341 of the female end 340. The button 382 disposed on the top cap 380 is mounted directly over the spring latch 369 of the retention member 360.

Moreover, with reference to FIG. 4A, when a user intends to push the 8P8C plug 400 into locked attachment with the adapter 300, the 8P8C plug 400 is manually inserted into the female end 340, and a latch base 420 of the 8P8C plug 400 is pushed forward to engage the push tab 364 of the retention member 360.

As illustrated in FIG. 4B, as the 8P8C plug 400 is pushed forward, the latch base 420 presses the push tab 364 of the retention member 360 and drives the entire retention member 360 as indicated by the direction of a corresponding arrow in FIG. 4B. The pair of V-shape-indents 347-1 formed along the pair of first ledges 347 then pushes the pair of V-shape arms 362 closer together, and the holders 363 of the pair of V-shape arms 362 move inwardly (as indicated by corresponding arrows) and enter into the lower vacant space 438 beneath the retention latch 432 in order to hold the latch base 420. Meanwhile, the pair of V-shape arms 362 is extended such that spring energy is stored. Simultaneously, the pair of V-shape springs 366 is pressed and bent such that spring energy is stored. Finally, as illustrated in FIG. 4C, the protrusion point 346 extending downward from the female end 340 presses down the spring latch 369 as the push tab 364 is pushed by the latch base 420 such that the protrusion point 346 engages the latch hole 368 on the spring latch 369. As a result, a locked attachment between the 8P8C plug 400 and the adapter 300 is accomplished.

In order to disconnect the 8P8C plug 400 from the adapter 300, the button 382 on the upper top cap 380 of the female end 340 is manually pushed. As mentioned above, the button 382 is mounted directly over the spring latch 369. When the button 382 is pushed, the button 382 engages the spring latch 369, and as a result the spring latch 369 is depressed by the button 382, thereby enabling the protrusion point 346 to disengage from the latch hole 368. In the meantime, the depressed V-shape springs 366 drive the entire retention member 360 backward, and the stored spring energy of the V-shape springs 366 is released. Moreover, the push tab 364 pushes the latch base 420 such that the holders 363 of the pair of V-shape arms 362 no longer hold the latch base 420. Consequently, the stored spring energy of the pair of V-shape arms 362 is released. As a result of the released spring energy, the 8P8C plug 400 is automatically ejected from the female end 340.

Figure 5:
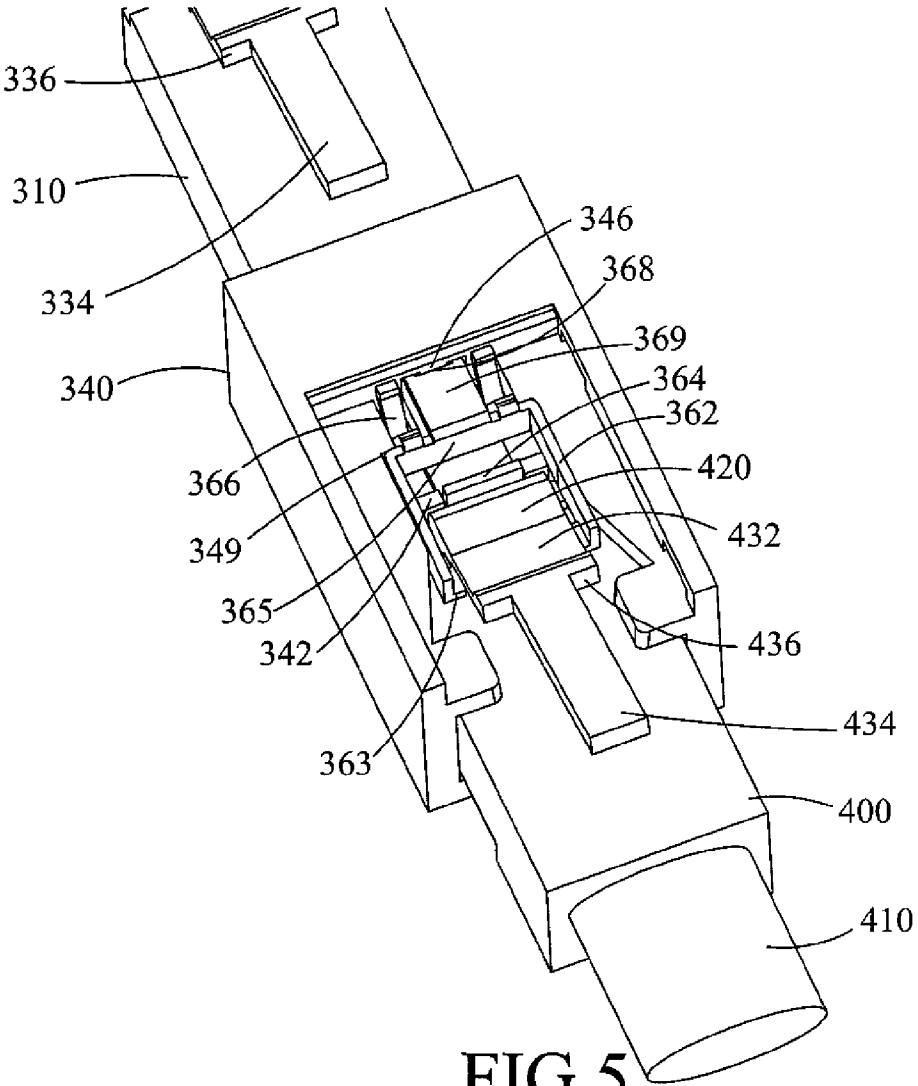
FIG. 5 is an exploded perspective view that shows insertion of an 8P8C plug having an undamaged retention latch into the female end of the adapter in accordance with an exemplary embodiment.

As previously discussed in accordance with an exemplary embodiment, during the plug insertion process the holders 363 move inwardly and enter into the lower vacant space 438 beneath the retention latch 432 in order to hold the latch base 420 of the 8P8C plug 400. Accordingly, the exemplary embodiment may be used for an 8P8C plug with an undamaged retention latch as well as an 8P8C plug with a damaged retention latch of any type. FIG. 5 is an exploded perspective view that shows insertion of an 8P8C plug 400 having an undamaged retention latch 432 into the female end 340 of the adapter 300 in accordance with an exemplary embodiment.

While the various embodiments described herein have been presented with the 8P8C connector as an example, it could be applied to any other type of connector (e.g. RJ11, MT-RJ, and LC fiber-optic connectors). Furthermore, an adapter in accordance with an exemplary embodiment may comprise only the female end 340 as a female receptacle for engaging a connector plug having a flexible retention latch, no matter where the flexible retention latch is damaged.

The illustration of the various embodiments described herein with reference to the drawings is provided for a better understanding of the characteristics and spirit of these embodiments. It will be understood that the various embodiments are not limited to the particular exemplary embodiments described herein but rather are capable of various modifications and rearrangements without departing from their scope. Therefore, it is intended that the following claims, accompanied by detailed descriptions giving the broadest explanation, not only define the scope of the various embodiments but also cover all modifications and changes that fall within their true spirit and scope.

What is claimed is:

1. An adapter for engaging a connector plug, said adapter comprising:

a male end disposed at one end of said adapter for connecting said adapter to a female receptacle corresponding to said connector plug, wherein said male end is substantially similar in shape to said connector plug;

a female end disposed at another end of said adapter for engaging said connector plug, said female end comprising a top cap having a button disposed thereon; and a retention member comprising:

a holder section for holding said connector plug;

an energy storage section for storing energy resulting from when said connector plug engages said retention member; and an energy release section for releasing said energy when engaged by said button such that said connector plug automatically ejects from said adapter.

2. The adapter according to claim 1, wherein said connector plug is an 8P8C plug, a RJ11 plug, a MT-RJ plug, or a LC plug.

3. The adapter according to claim 1, wherein said retention member is formed of stainless steel plate.

4. The adapter according to claim 1, wherein said holder section comprises a pair of V-shape arms, and wherein each of said pair of V-shape arms comprises a holder.

5. The adapter according to claim 1, wherein said energy storage section comprises a pair of V-shape springs.

6. The adapter according to claim 1, wherein said energy release section comprises a spring latch having a latch hole for engagement with a protrusion point on said female end.

7. The adapter according to claim 6, wherein said latch hole engages said protrusion point when said connector plug engages said retention member.

8. The adapter according to claim 1, wherein said retention member further comprises a push tab via which said retention member is driven when said connector plug is inserted into said female end.

9. The adapter according to claim 1, wherein said female receptacle is a wall outlet or a receptacle on another device.

10. The adapter according to claim 1, wherein said female end comprises a body, and wherein said body comprises:

a first compartment for receiving said connector plug; and a second compartment for receiving said energy storage section and said energy release section.

11. A female receptacle for engaging a connector plug, said female receptacle comprising:

a body for engaging said connector plug;

a top cap mounted on said body, said top cap having a button disposed thereon; and a retention member mounted within said body, said retention member comprising:

a holder section for holding said connector plug;

an energy storage section for storing energy resulting from when said connector plug engages said retention member; and an energy release section for releasing said energy when engaged by said button such that said connector plug automatically ejects from said female receptacle.

12. The female receptacle according to claim 11, wherein said connector plug is an 8P8C plug, a RJ11 plug, a MT-RJ plug, or a LC plug.

13. The female receptacle according to claim 11, wherein said retention member is formed of stainless steel plate.

14. The female receptacle according to claim 11, wherein said holder section comprises a pair of V-shape arms, and wherein each of said pair of V-shape arms comprises a holder.

15. The female receptacle according to claim 11, wherein said energy storage section comprises a pair of V-shape springs.

16. The female receptacle according to claim 11, wherein said energy release section comprises a spring latch having a latch hole for engagement with a protrusion point on said female receptacle.

17. The female receptacle according to claim 16, wherein said latch hole engages said protrusion point when said connector plug engages said retention member.

18. The female receptacle according to claim 11, wherein said retention member further comprises a push tab via which said retention member is driven when said connector plug is inserted into said female receptacle.

19. The female receptacle according to claim 11, wherein said body comprises:

a first compartment for receiving said connector plug; and a second compartment for receiving said energy storage section and said energy release section.

* * * * *